US007703498B2

(12) United States Patent
Holevas

(10) Patent No.: US 7,703,498 B2
(45) Date of Patent: Apr. 27, 2010

(54) HIDDEN WINDOW SCREEN

(76) Inventor: Michael Holevas, 58-25-229th St., Bayside, NY (US) 11364

( * ) Notice: Subject to any disclaimer, the term of this patent is extended or adjusted under 35 U.S.C. 154(b) by 192 days.

(21) Appl. No.: 11/161,610

(22) Filed: Aug. 9, 2005

(65) Prior Publication Data

US 2007/0033880 A1 Feb. 15, 2007

(51) Int. Cl.
*A47H 1/00* (2006.01)

(52) U.S. Cl. ..... 160/28; 160/27; 160/99; 160/100

(58) Field of Classification Search ..... 160/28, 160/271, 99, 100, 268.1, 270, 240, 266, 44, 160/290.1, 27; 49/505, 471; 16/94, 96 R
See application file for complete search history.

(56) References Cited

U.S. PATENT DOCUMENTS

| | | | | |
|---|---|---|---|---|
| 68,326 | A | 8/1867 | Whittier | |
| 225,021 | A | 3/1880 | Phelan | |
| 290,496 | A | 12/1883 | Thompson | |
| 292,410 | A | 1/1884 | Clark | |
| 465,595 | A | 12/1891 | Lincoln | |
| 507,011 | A | 10/1893 | Jay | |
| 577,690 | A | 2/1897 | Monroe | |
| 587,743 | A | 8/1897 | Lambert | |
| 714,898 | A | 12/1902 | Harrison | |
| 716,751 | A | 12/1902 | Phillips | |
| 740,033 | A | 9/1903 | McNamara | |
| 998,102 | A | 7/1911 | Ladwig et al. | |
| 1,055,381 | A | 3/1913 | Born | |
| 1,059,872 | A | 4/1913 | Hoegner | |
| 1,118,086 | A * | 11/1914 | White | 160/28 |
| 1,126,442 | A | 1/1915 | Fulde | |
| 1,141,996 | A | 6/1915 | Vanasdale | |
| 1,167,526 | A | 1/1916 | Scheeren | |
| 1,177,434 | A | 3/1916 | Montgomery et al. | |

(Continued)

FOREIGN PATENT DOCUMENTS

| | | |
|---|---|---|
| DE | 39 29 284 | 4/1991 |

(Continued)

OTHER PUBLICATIONS

Mar. 2004 http://media.popularmechanics.com/images/IMG_0050-lg.jpg.*

(Continued)

*Primary Examiner*—Katherine W Mitchell
*Assistant Examiner*—Candace L. Bradford
(74) *Attorney, Agent, or Firm*—Collard & Roe, P.C.

(57) ABSTRACT

A window screen assembly for a window, which is disposed in a window frame. This assembly can include a housing coupled to a window frame, at least one screen disposed in the housing window frame, and at least one lock for selectively locking the screen to the window. In this case, the screen can be locked to the window, so that it moves with the window in the window frame. An end attachment element can also be coupled to the screen wherein this attachment element can be designed to either stand up in a window to allow attachment to the lock or catch on the window or to lay flat to allow for inactivity and detachment of the screen from the window.

25 Claims, 14 Drawing Sheets

U.S. PATENT DOCUMENTS

| | | | | | |
|---|---|---|---|---|---|
| 1,188,411 | A | | 6/1916 | Burrowes | |
| 1,240,768 | A | | 9/1917 | O'Neill | |
| 1,342,298 | A | | 6/1920 | O'Neill | |
| 1,344,758 | A | | 6/1920 | Donnelly | |
| 1,556,436 | A | | 10/1925 | Gorayeb | |
| 1,634,312 | A | | 7/1927 | Zecchino | |
| 1,636,255 | A | | 7/1927 | Stickle | |
| 1,779,845 | A | | 10/1930 | Harring | |
| 1,833,745 | A | | 11/1931 | Gralinski | |
| 1,846,320 | A | | 2/1932 | Dixson | |
| 1,892,787 | A | | 1/1933 | Rubin | |
| 1,933,584 | A | | 11/1933 | Brewer | |
| 2,051,422 | A | | 8/1936 | Rissmann | |
| 2,056,341 | A | | 10/1936 | Bulmer | |
| 2,191,166 | A | | 2/1940 | Dollstedt et al. | |
| 2,243,790 | A | | 5/1941 | Blood | |
| 2,261,141 | A | | 11/1941 | Davis | |
| 2,261,142 | A | | 11/1941 | Davis | |
| 2,314,026 | A | | 3/1943 | Willett | |
| 2,327,232 | A | | 8/1943 | Wheeler | |
| 2,354,832 | A | | 8/1944 | Ristine | |
| 2,462,520 | A | | 2/1949 | Marbach | |
| 2,573,590 | A | | 10/1951 | Mosebach | |
| 2,595,508 | A | | 6/1952 | Bridges | |
| 2,826,789 | A | * | 3/1958 | Etling | 49/459 |
| 3,005,489 | A | * | 10/1961 | Crocker et al. | 160/28 |
| 3,017,927 | A | | 1/1962 | Demko | |
| 3,105,542 | A | | 10/1963 | Lynch | |
| 3,244,222 | A | | 4/1966 | Johnson | |
| 3,314,201 | A | * | 4/1967 | Riegelman | 52/209 |
| 3,470,934 | A | * | 10/1969 | Agnew | 160/27 |
| 3,503,169 | A | * | 3/1970 | Maki et al. | 52/209 |
| 3,552,471 | A | * | 1/1971 | Hurst et al. | 160/27 |
| 3,911,990 | A | | 10/1975 | Hoover et al. | |
| 4,125,141 | A | * | 11/1978 | Stillwell | 160/91 |
| 4,311,183 | A | * | 1/1982 | Herbst et al. | 160/37 |
| 4,558,536 | A | * | 12/1985 | Dunsmoor | 49/404 |
| 5,090,469 | A | | 2/1992 | Boulanger | |
| 5,092,388 | A | | 3/1992 | Evers | |
| 5,682,710 | A | | 11/1997 | Davies et al. | |
| 5,687,506 | A | | 11/1997 | Davies et al. | |
| 5,915,443 | A | * | 6/1999 | Lindley, Jr. | 160/100 |
| 5,946,857 | A | | 9/1999 | Davies et al. | |
| 6,059,007 | A | | 5/2000 | Tomita | |
| 6,070,642 | A | * | 6/2000 | Douglas et al. | 160/310 |
| 6,123,135 | A | | 9/2000 | Mathews | |
| 6,135,186 | A | | 10/2000 | Lindley, Jr. | |
| 6,167,936 | B1 | * | 1/2001 | Stover et al. | 160/27 |
| 6,186,215 | B1 | | 2/2001 | DeYoung et al. | |
| 6,223,803 | B1 | | 5/2001 | Nielsen | |
| 6,311,439 | B1 | * | 11/2001 | Arcati et al. | 52/204.51 |
| 6,374,557 | B1 | * | 4/2002 | O'Donnell | 52/209 |
| 6,446,696 | B1 | | 9/2002 | Davies et al. | |
| 6,470,947 | B1 | * | 10/2002 | Holevas | 160/28 |
| 6,499,527 | B1 | * | 12/2002 | Lindley, Jr. | 160/28 |
| 6,701,994 | B2 | | 3/2004 | Goldenberg et al. | |
| 2005/0051280 | A1 | | 3/2005 | Thomas et al. | |

FOREIGN PATENT DOCUMENTS

| | | |
|---|---|---|
| GB | 2 327 232 | 1/1999 |
| WO | WO 93/18692 | 9/1993 |
| WO | WO 97/34069 | 9/1997 |

OTHER PUBLICATIONS

Printout of a Screenshot of an Animation Shown First in Mar. 2004. CD-ROM of Animation played at Invent Now Competition Mar. 2004; Played at Inpex Invention Show May 2004.

* cited by examiner

FIG. 4A
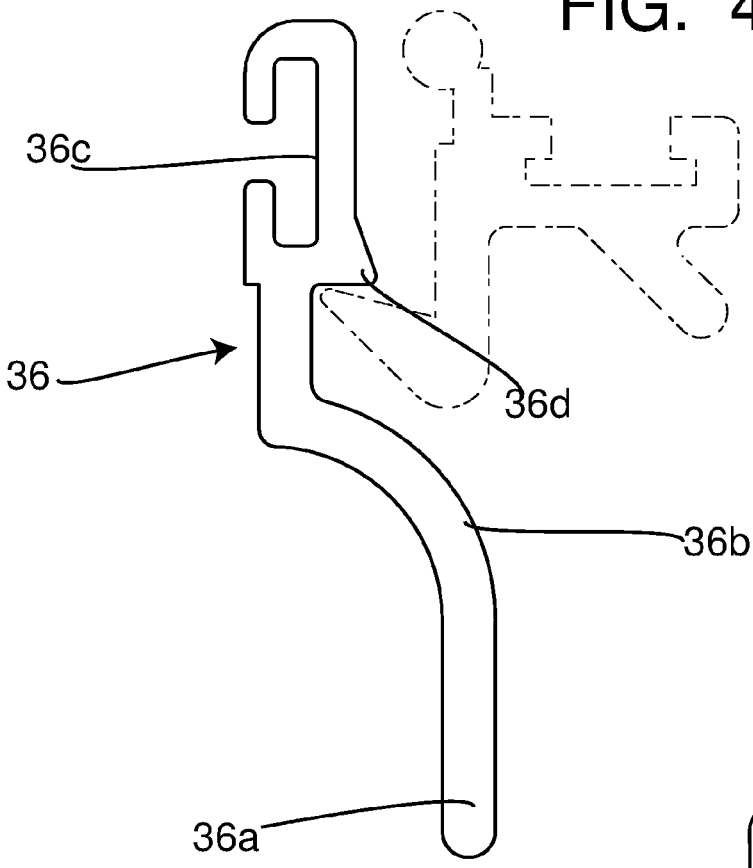
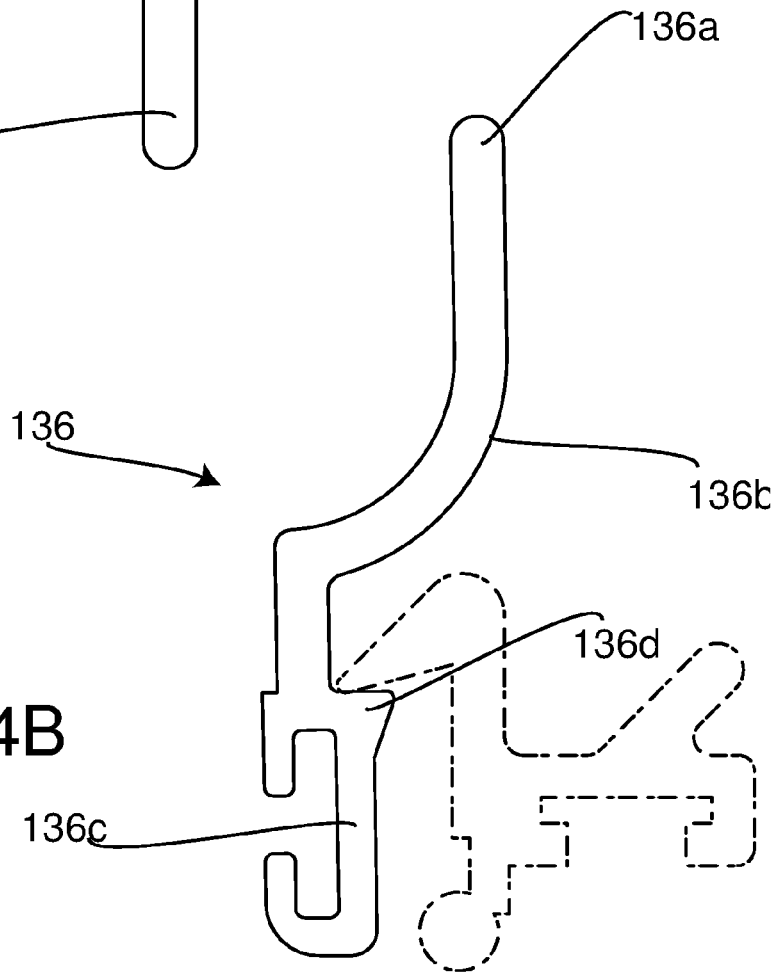
FIG. 4B

HIDDEN WINDOW SCREEN

BACKGROUND

The invention relates to a hidden window screen that can be disposed in a housing in a window frame when not in use and then unfurled from this housing when in use.

Other hidden window screens are known in the art. For example, U.S. Pat. No. 6,470,947 to Holevas issued on Oct. 29, 2002 relates to window screens wherein the disclosure of which is incorporated herein by reference.

SUMMARY

The invention relates to a window screen assembly for a window being disposed in a window frame. This assembly can include a housing coupled to a window frame, at least one screen disposed in the housing window frame, and at least one lock for selectively locking the screen to the window sash. In this case, the screen can be locked to the window sash, so that it moves with the sash in the window frame.

This lock can be in the form of a catch. The lock can include a spring and be biased in a closed position from the spring to lock the screen to the sash. The lock can include a body section for housing the spring and a flange extending out from the lock this body section. The lock can thus be rotationally coupled to the window or window frame to allow for rotational movement against the spring to open the lock. Otherwise, the lock is biased by the spring to keep the lock closed and latched to the screen.

When the sash is unlatched from the screen, the system is designed so that the movement of the sash into a closed position, creates a latching movement so that the lock snaps over a flange to connect the screen to the window sash.

There can also be an optional sash lock coupled to the window frame. This sash lock can be for selectively locking the window sash in a closed position. The sash lock can be in the form of a catch for securing over a frame on a window. This sash lock can include a housing, which can be used to house a spring such as a leaf spring. This sash lock can be rotationally coupled to the window sash so that when a user presses on a flange, it can rotate the sash lock against the spring to open the sash lock so that the user can then open the window.

The screen can be housed in a compact housing wherein this housing can include a one-way valve to allow fluid to flow out from the housing. Disposed inside of the housing can be a screen in the form of a roll up screen. Disposed inside of the screen roll can be a torsion spring, which is coupled to the roll up screen.

The screen can also include an attachment element which can be in the form of a uniquely shaped flange, which due to its shape allows this element to either stand up in a groove in the window frame so that it is in a position to be latched, or to lay flat in the window frame so that it is in a position to successively remain at rest so that when the window moves into a closed position, the screen lock does not contact the attachment element which would automatically secure the screen to the window.

In at least one embodiment, there can be at least one remote actuator coupled to the window frame. This remote actuator can be for remotely moving or actuating the screen lock. An extending connector connects to the remote actuator at a first end and can extend through the window sash frame to connect to the screen lock at an opposite end. This remote actuator can be selectively moved, thus moving the extending connector to selectively move the lock from a first position, to a second position, to either selectively lock the lock to the screen, or selectively unlock the lock from the screen.

Because the lock is normally biased in a closed or locked position, by simply releasing the remote actuator, the user can have the lock return to its original locking position.

By selectively coupling the screen to a window sash frame, a user can have an improved system wherein this screen selectively moves with the window. While this system can be coupled to vertically moving windows it can also be coupled to horizontally moving windows as well.

BRIEF DESCRIPTION OF THE DRAWINGS

Other objects and features of the present invention will become apparent from the following detailed description considered in connection with the accompanying drawings, which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 4A is a side view of the bracket shown in FIG. 1A; and

FIG. 4B is a side view of the bracket shown in FIG. 2A;

DETAILED DESCRIPTION

Figure 1:
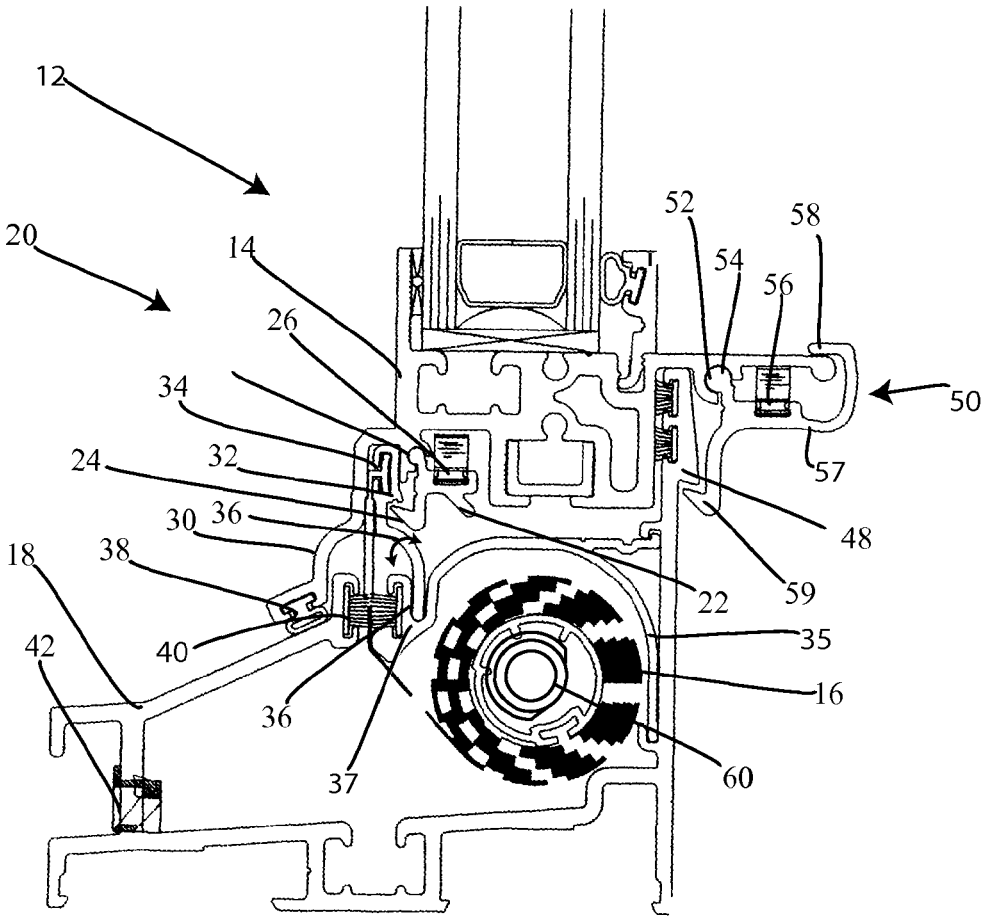
FIG. 1A shows a side cross-sectional view of a bottom section of a window including the invention with a connecting bracket in an upright position.
FIG. 1B shows a side cross-sectional view of a bottom section of a window including the invention with the connecting bracket in a collapsed or down position.
Figure 1A:
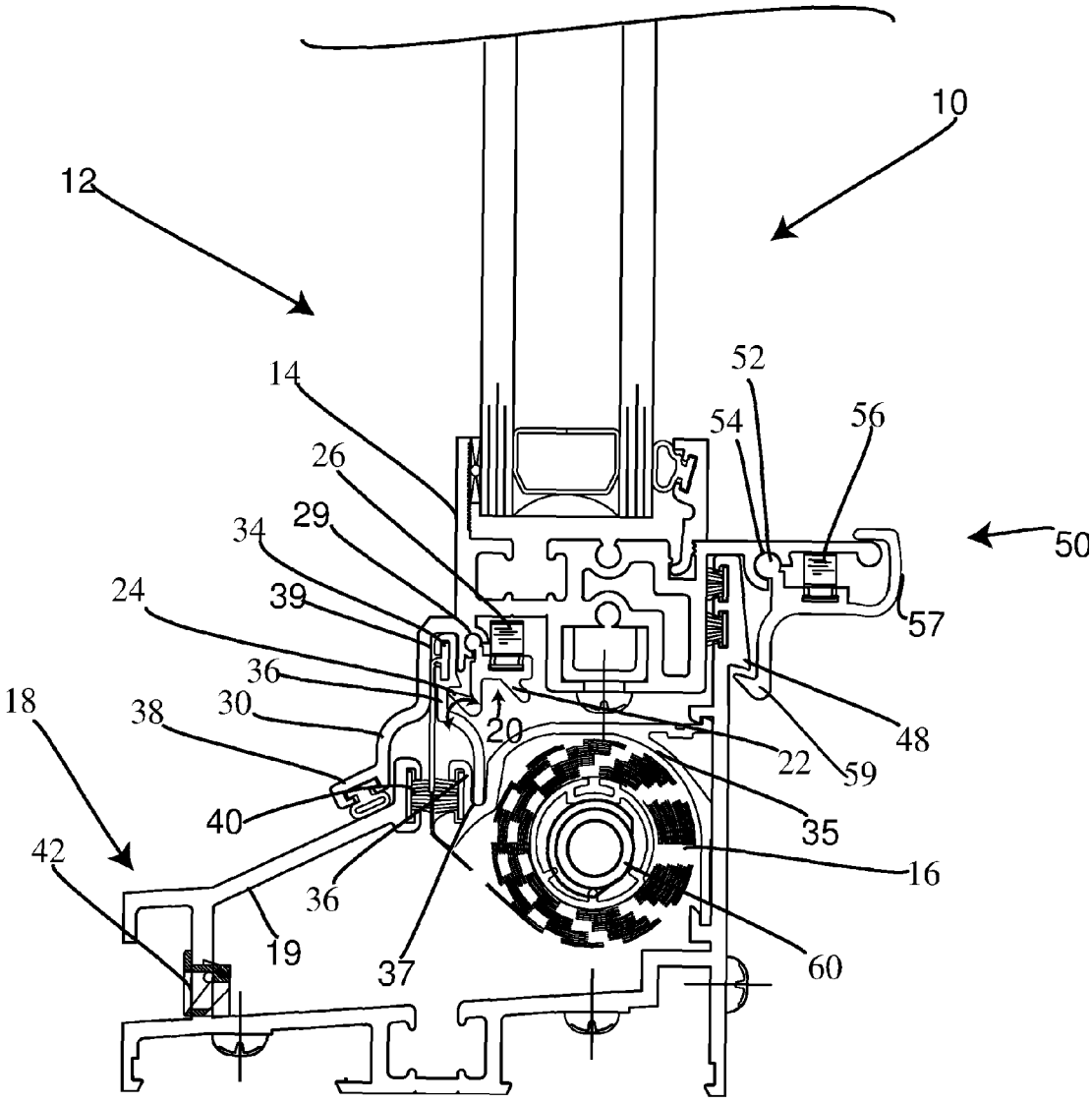

Referring in detail to the drawings FIG. 1A shows a side cross sectional view of a window, which can be in the form of a sash window having a screen device coupled to a bottom end of the window frame 19. In this case, there is shown the device 10 which can be coupled to a window sash 12 having a bottom sash frame section 14. This device 10 can include a screen 16 which can be in the form of a roll up screen that is rotationally coupled inside of a housing 18. Housing 18 is formed from cover 35 being coupled to bottom window frame member 19. Housing, and in particular cover 35 is formed from a material having sufficient rigidity to support bracket 36 in a groove 37 in a substantially rigid and upright manner. In addition, housing 18 has a one-way valve 42 coupled to an exterior region of this housing to allow water or other moisture to flow out therefrom.

Figure 3A:
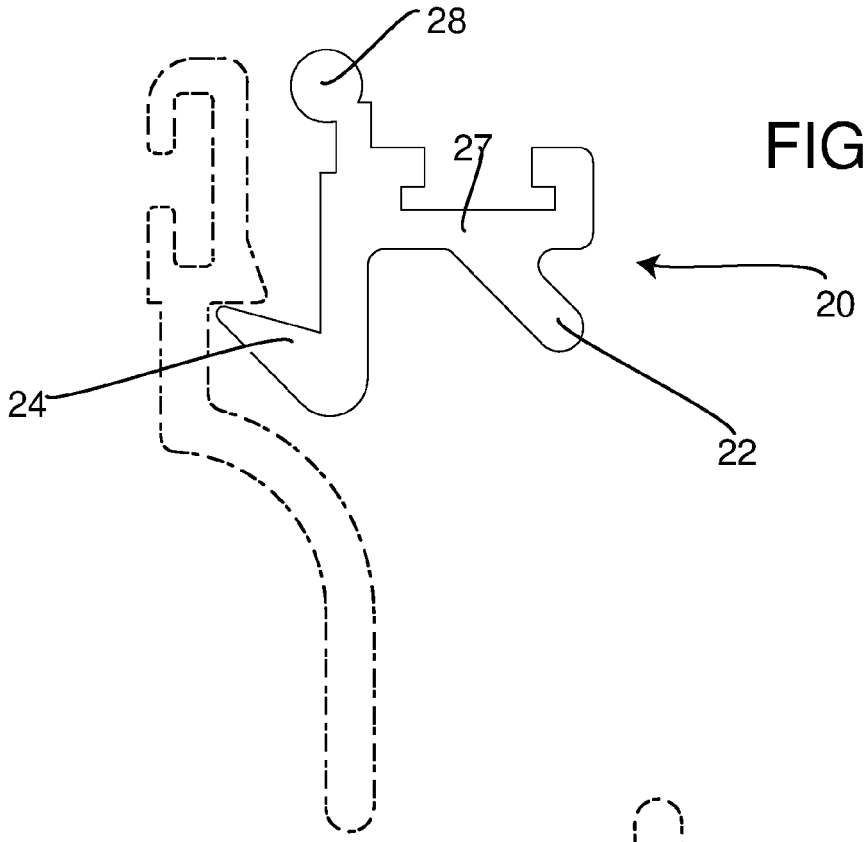
FIG. 3A is a side view of the lock shown in FIG. 1A.

This screen 16 can be selectively coupled to the window sash 12 or the bottom sash frame section 14 via a catch or lock element 20, which is shown in FIG. 1A but also is shown in greater detail in FIG. 3A. Catch or lock element 20 can include a flange 22 which allows a user to hold and move the catch with his or her fingers, this flange is coupled to rotational mounting element or hinge 28, which is rotationally coupled to frame section 14 in a socket 29. Hinge 28 can be in the form of a ball or rounded rim and socket joint. A latch flange 24 is coupled to catch 20 forming the catch portion, wherein this latch flange can be in the form of a hook that snaps around an associated screen adapter 36. There is also a spring 26 which can be in the form of a leaf spring, which keeps catch or lock 20 biased in a closed position so that once catch 20 locks onto a screen, it stays in the locked position until readjusted by the user using flange 22 to release lock or catch or lock 20.

Bottom frame section 14 can also include a cover section 30, which can extend out in a curved manner to create an open region for screen 16 to extend up. Screen 16 can extend up through opposing bristles 40 and includes a coupling flange 34 coupled to the end of screen 16. In this case, coupling flange 34 can be coupled to a bracket which can be in the form of an adjustable coupler, lock or adapter 36. This coupler, adapter, or lock 36 can be in the form of a curved bracket. This curved bracket is shown in greater detail in FIG. 4A and can include a first base region 36*a*, a curved section 36*b*, a bracket section 36*c*, and a connecting flange 36*d*.

First base region 36*a* is for coupling into a rim, channel or indent 37 in screen housing cover 35. In this position, first base region 36*a* fits snugly and is secured laterally on both sides of this channel 37.

The next section 36*b* is a curved section, which curves over from bottom section 36*a* to a region adjacent to screen 16.

Bracket section 36*c* can be used to allow connection flange 34 to connect onto this bracket section. In this case, bracket section 36*c* has a channel that allows connection flange 34 to connect thereto. In addition, there is also a flange 36*d*, which extends out from bracket section 36*c* so that flange 36*d* serves as a connection surface for connecting to clip or hook section 24.

Figure 1B:
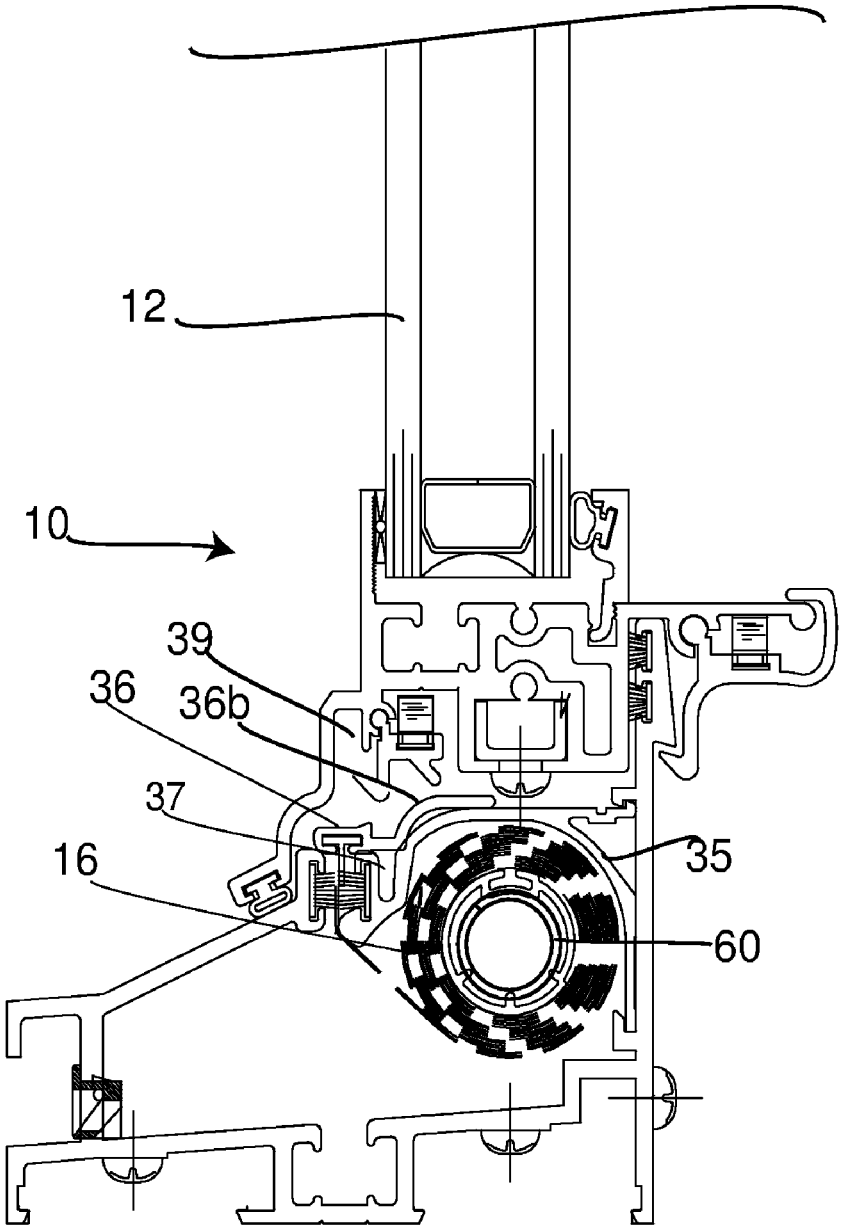

When a user is interested in allowing this bracket to be continuously disconnected, he can position it so that it lies flat so that it is continuously disconnected from catch or lock 24. As shown in FIG. 1B, bracket 36 can then lie flat because curved region 36*b* can be used to wrap around a curved section of housing cover 35. When this bracket is in its flat position, screen 16 is essentially in its fully retracted position and this bracket 36 can then be used to cover the screen opening section and form a bottom resting position for bracket 36. Spring 60 is disposed inside of roll up screen 16 and can be used to bias screen 16 in a closed position and also pull bracket 36 in a flat position when not in use.

As shown in FIGS. 1A and 1B, there is also an optional window lock 50 which can be coupled to bottom sash frame section 14 of window sash 12. This lock can include a hinge or rounded section 52 which can be coupled to a recess or socket section 54 in bottom sash frame section 14. There is also a spring 56, wherein this spring can be in the form of any known spring, such as a leaf spring. A body 57 of this lock can also extend around to a clip to form an essentially closed body which houses spring 56 and also hinge or ball section 52. A clip section 59 extends out from this lock so that this clip section 59 can be locked over a flange section 48 of bottom housing 18.

Figure 2A:
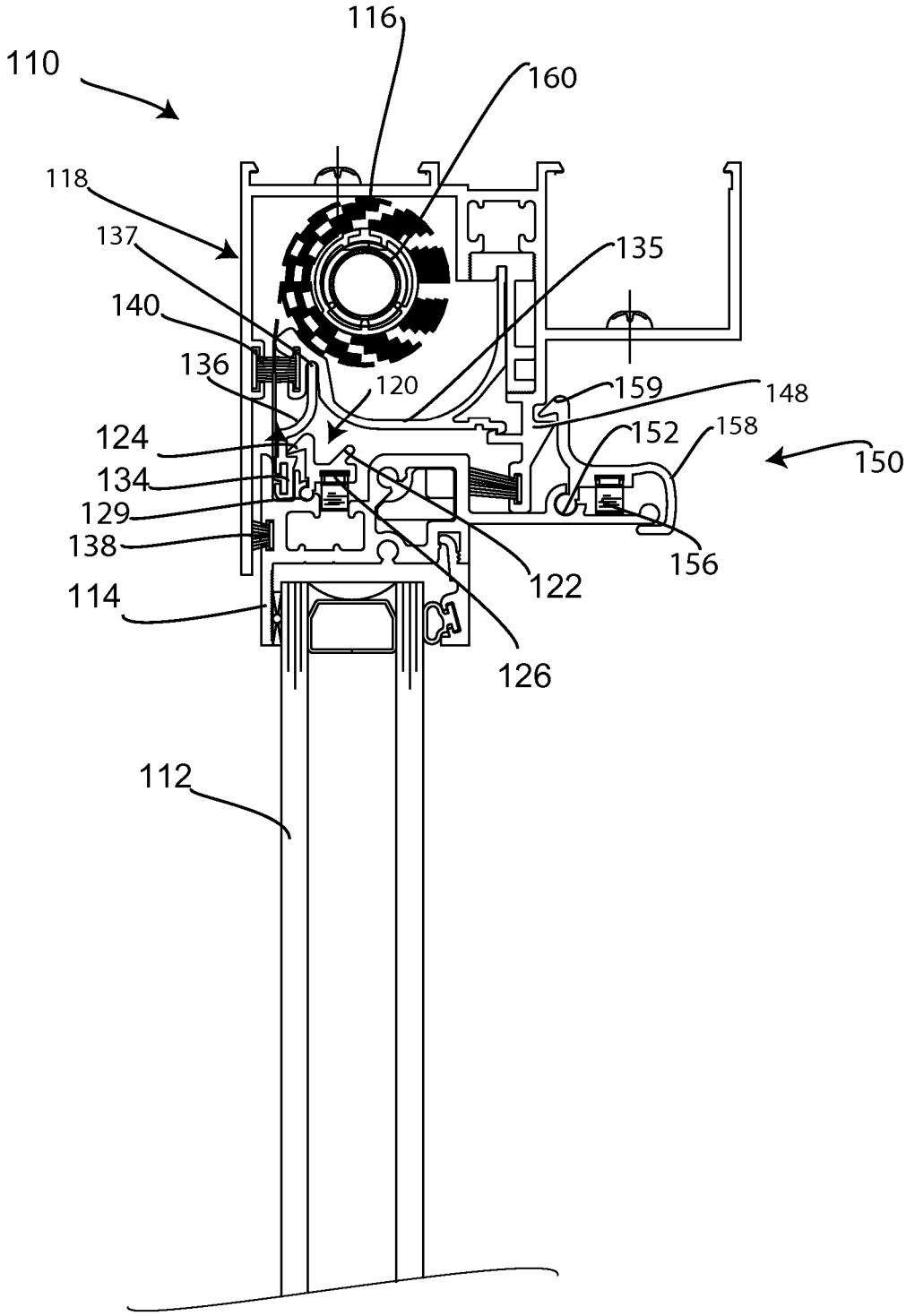
FIG. 2A shows a side cross-sectional view of a top section of a window including another embodiment of the invention with the bracket in an extended downward position.

FIG. 2A shows a cross-sectional view of the device coupled to the top section of a window such as a sash window wherein this top section can be coupled to the top part of the window sash opposite the device shown in FIG. 1A.

In this case, this device 110 is similar to device 10.

Figure 2B:
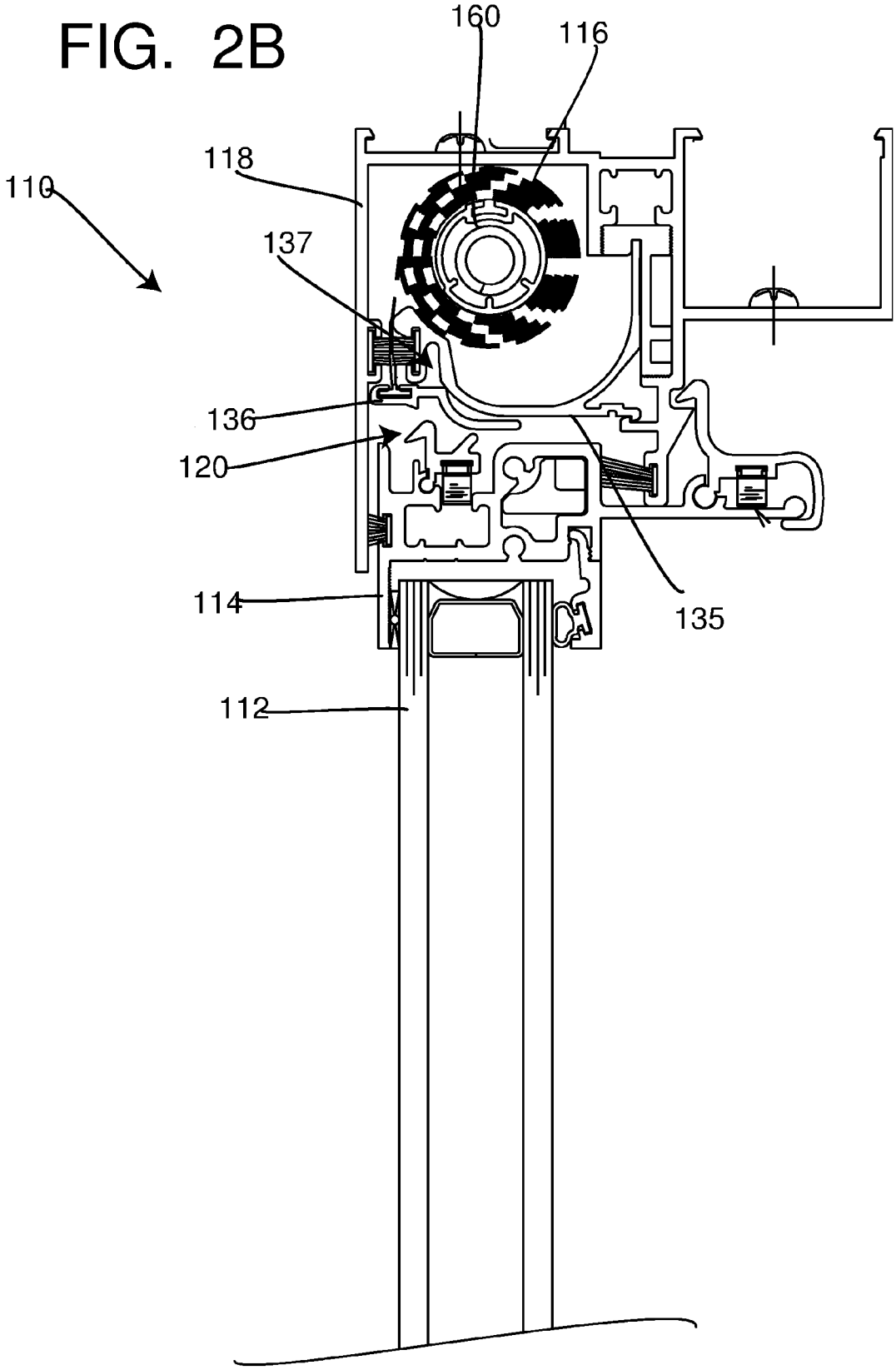
FIG. 2B shows a side cross-sectional view as shown in FIG. 2A with the bracket in a collapsed position.
Figure 3B:
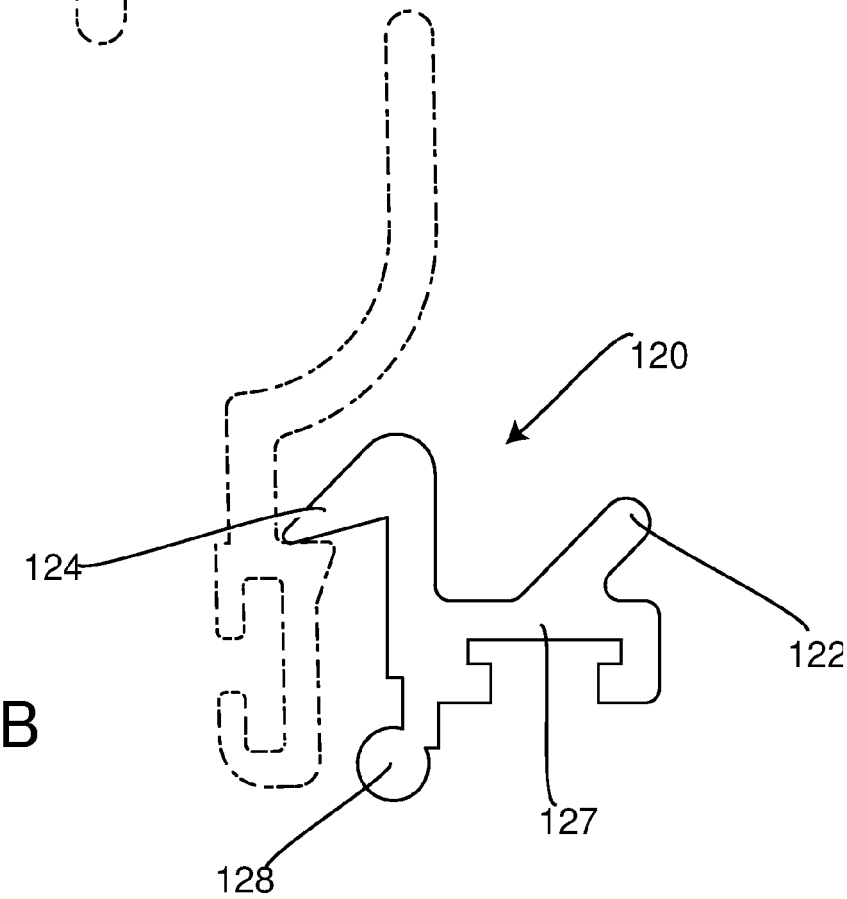
FIG. 3B is a side view of the lock shown in FIG. 2A.

For example, the top part of window sash 112 can be coupled to a window sash frame element 114 which can be coupled to a lock 120, which is shown in FIGS. 2*a* and 2B and in greater detail in FIG. 3B.

Lock 120 can be rotatably coupled to frame 114 wherein lock 120 has a main body 127, an extending flange 122, a clip or hook section 124, and a rotatable ball joint 128 that can fit into socket 129 in upper frame 114. There is also a spring 126 which can be in the form of a leaf spring. Spring 126 acts to bias lock or clip 120 in a closed manner.

Screen 116 has a connection flange 134 coupled to the end of it. Connection flange 134 can be coupled to an adjustable coupler or lock 136. This coupler or lock 136 can be in the form of a curved bracket. This curved bracket or adapter is shown in greater detail in FIG. 4B and can include a first base region 136*a*, a curved section 136*b*, a bracket section 136*c*, and a connecting flange 136*d*.

First base region 136*a* is for coupling into a rim, channel or indent 137 in housing cover 135. In this position, first base region 136*a* fits snugly and is secured laterally on both sides of this channel 137.

The next section 136*b* is a curved section, which curves over from bottom section 136*a* to a region adjacent to screen 116.

Bracket section 136*c* can be used to allow connection flange 134 to connect onto this bracket section. In this case, bracket section 136*c* has a channel that allows connection flange 134 to connect thereto. In addition, there is also a flange 136*d* which extends out from bracket section 136*c* so that flange 136*d* serves as a connection surface for connecting to clip or hook section 124.

When a user is interested in allowing this bracket 136 to be continuously disconnected, or disengaged, he can position it so that it lies flat. As shown in FIG. 2B, the screen can be continuously disconnected from catch or lock 124. Bracket 136 can then lie flat because curved region 136*b* can be used to wrap around a curved section of housing cover 135. When this bracket is in its flat position, screen 116 is essentially in its fully retracted position and this bracket 136 can then be used to cover the screen opening section wherein this bracket 136 can then be laid flat to form a top resting position for the top bracket 136 of the window sash frame 114.

This window sash 112 has an outer seal which can be formed from bristles 138 wherein these bristles keep air from moving from an outside region to an inside region.

To keep screen 116 clean, opposing bristles 140 are disposed within housing cover 118 so that when screen 116 unfurls or rotates into an open position, that screen self cleans.

There is also a window lock 150 which can include a rotational coupling or joint 152, a spring 156 for biasing the lock 150 in a closed position, a flange element 158, for the closing of a housing for this lock, and a clip section 159 which can be secured over a flange section 148 of housing cover 118 to lock window sash 112 in place.

When in use, the device can function so that the screen can be selectively coupled to either one of the top or bottom sashes. In this case, the screen can be coupled via either lock or connection element 24 or 124 to either a bottom sash frame 14 of window sash 12 or to a top sash frame 114 of window 112. As the windows rise up or lower down to meet the screens, locks 24 and 124 can automatically rotate with clip section 24 or 124 rotating against springs 26 or 126 to slide or rotate around their respective clips or connecting sections 36*d* or 136*d* to create a lock. Once this connection lock has been created, the screen can move with the associated window away from its rolled up state by moving window sash 12 up or window sash 112 down. Alternatively, if this window is moved into a closed position wherein window sash 12 is moved down, and window sash 112 is moved up, the screen naturally recoils via coil spring 60 or 160 disposed inside of screens 16 or 116 so that it does not become bunched or folded over when the window is moved back into a closed position.

Figure 4C:
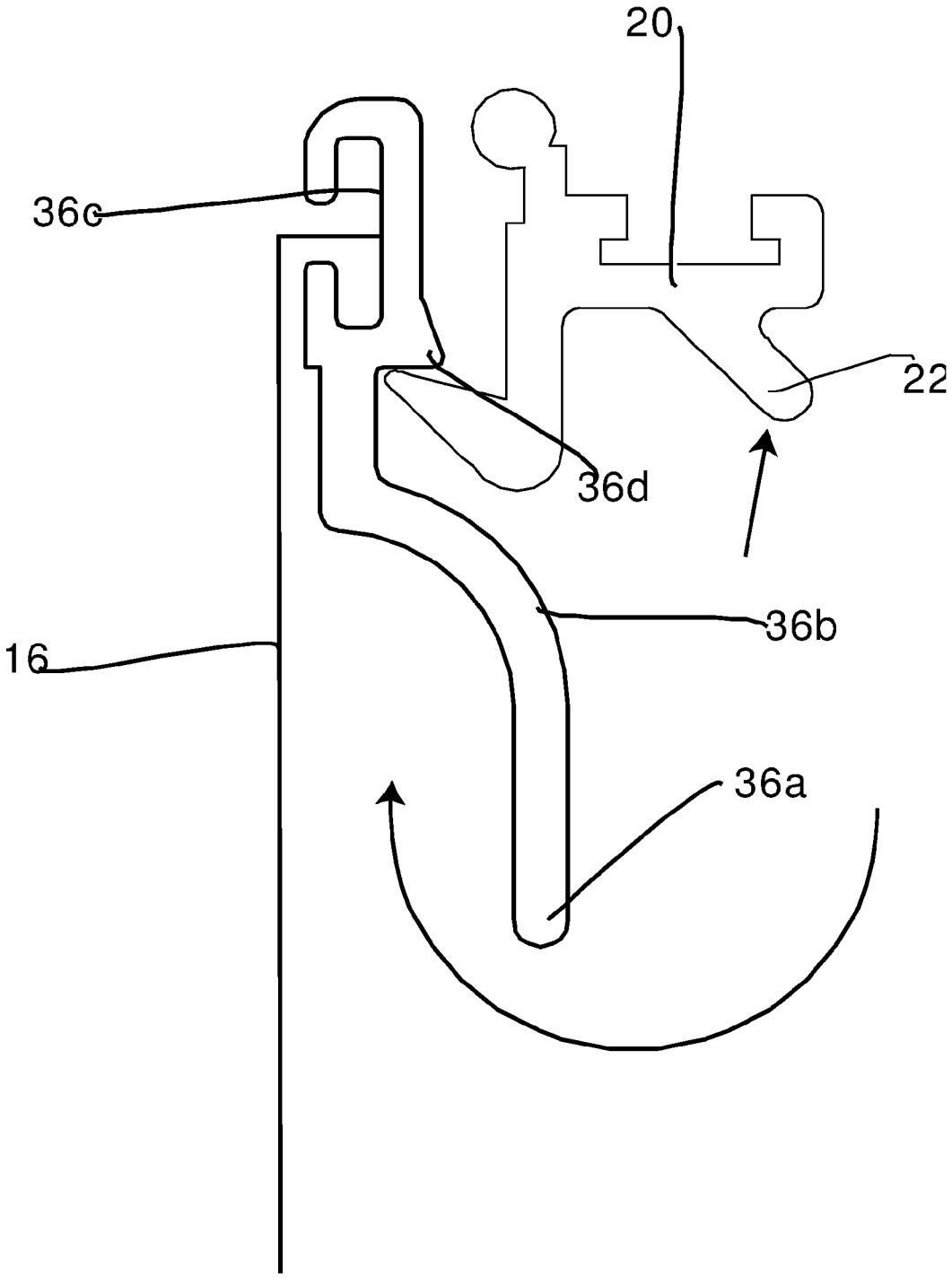
FIG. 4C shows a side view of the bracket and the lock showing the movement of fingers and thumbs to interact with the bracket and lock.
Figure 5A:
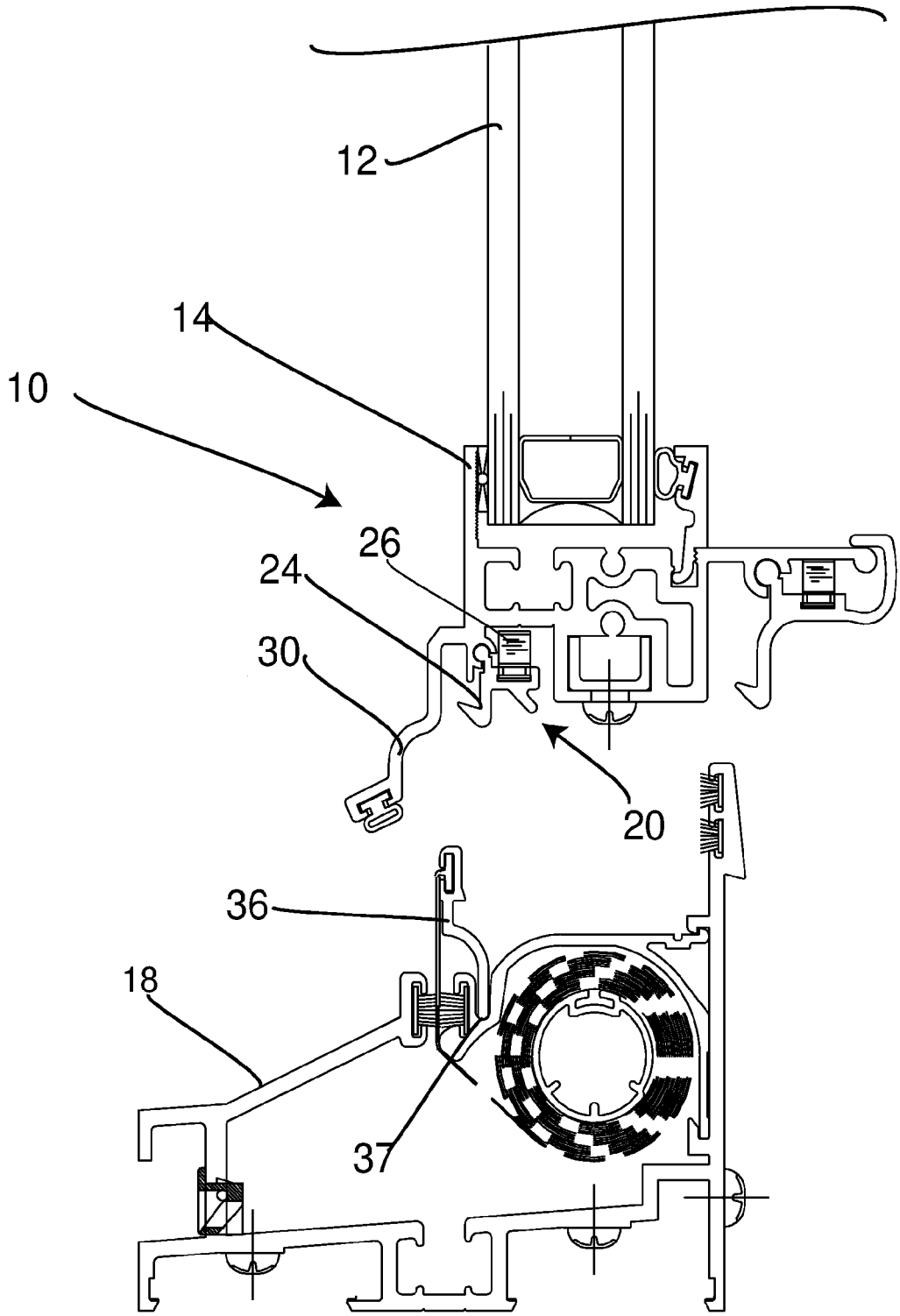
FIG. 5A is a side cross-sectional view of the device shown in FIG. 1A with the window in an open position and the screen unlatched.

FIG. 4C shows how lock 20 and bracket 36 are shaped and positioned so that these components can be easily manipulated to arrange bracket 36 into either a locking position or an unlocked position. For example, the curved section 36*b* can be used to extend this bracket out away from screen 16 to present a region for a user to slide his or her fingers up underneath bracket 36 when the window is open and bracket 36 is coupled to lock 20. When a user slides his or her fingers up and underneath bracket 36 as shown by the curved arrow, they can be used to brace against bracket 36 to pull it out and away from lock 20. The user can then also use his or her thumbs to press against extending flange 22 to unlock lock 20 from bracket 36. This movement then allows this bracket to be positioned as shown in FIG. 1B or in an alternate position as shown in FIG. 5A. The curves shown in this bracket 36 are also present in bracket 136 so these benefits are also available in the embodiment shown in FIGS. 2A and 2B.

FIG. 5A shows a side cross-sectional view of the device as shown in FIG. 1A. In this view, there is shown window sash 12 with window sash frame 14 being positioned above housing 18 and away from bracket 36. As seen here, bracket 36 and lock 20 are in a disconnected state. In this position, window sash 12 can move in a downward movement towards bracket 36 and housing 18 once lock 20 including latch flange 24 encounters bracket 36. The two elements can both latch together to form a locked connection.

Because the movement of window sash 12 down toward bracket 36 can be a rapid movement, bracket 36 is braced in channel 37. Bracket 36 can be formed from a material that has sufficient rigidity to stand upright and form a lock but sufficient flexibility to snap around lock 20 as lock 20 snaps in place.

In addition, as this window sash 12 moves down, lock 20 is secured in a spring loaded, but rotatable manner so lock 20 rotates against spring 26 during the initial interaction with bracket 36. By the time window 12 is fully down or closed, lock 20 has snapped back into place to lock with bracket 36.

Figure 5B:
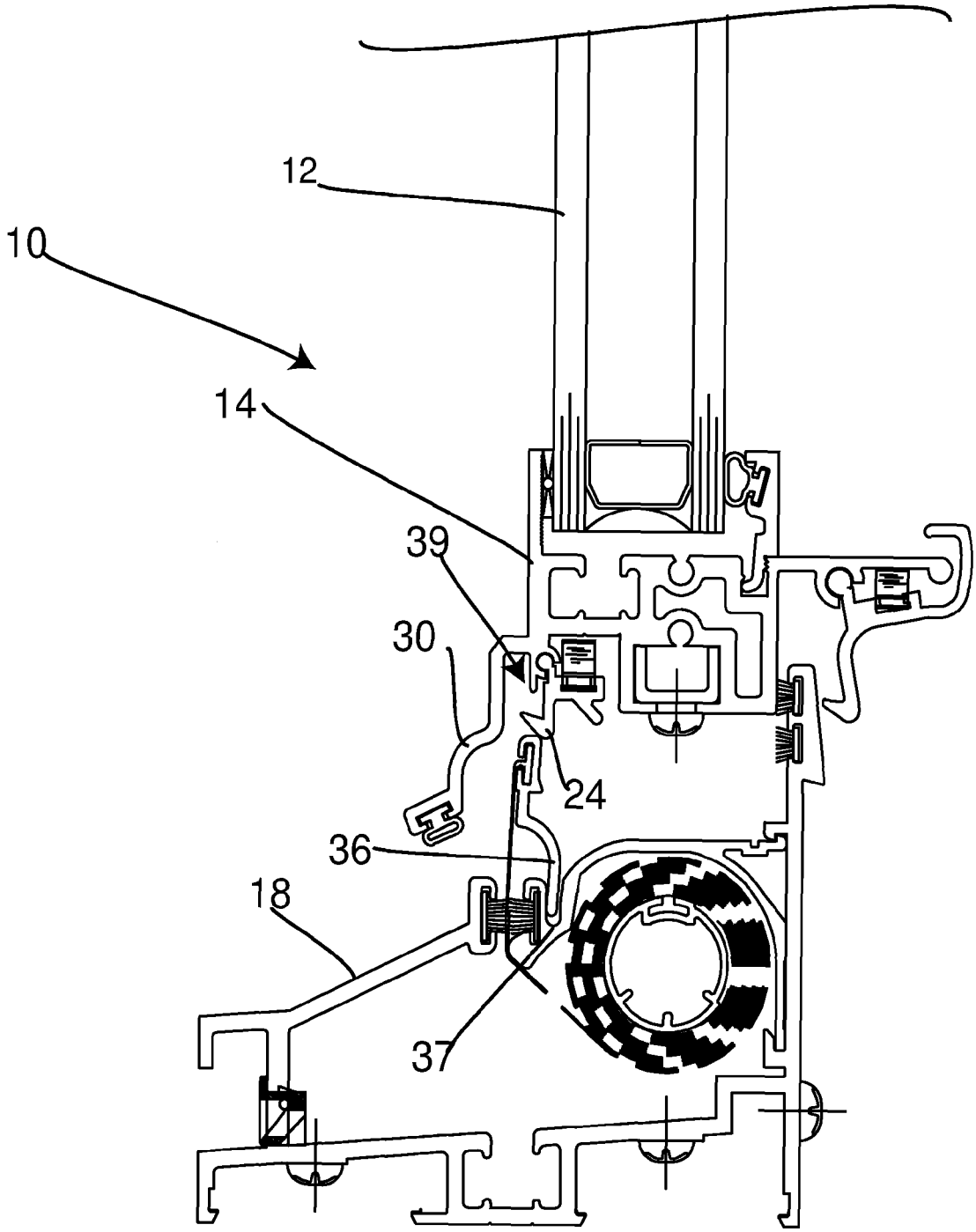
FIG. 5B is a side cross-sectional view of the device shown in FIG. 1A, with the bracket in a first misaligned position.
Figure 5C:
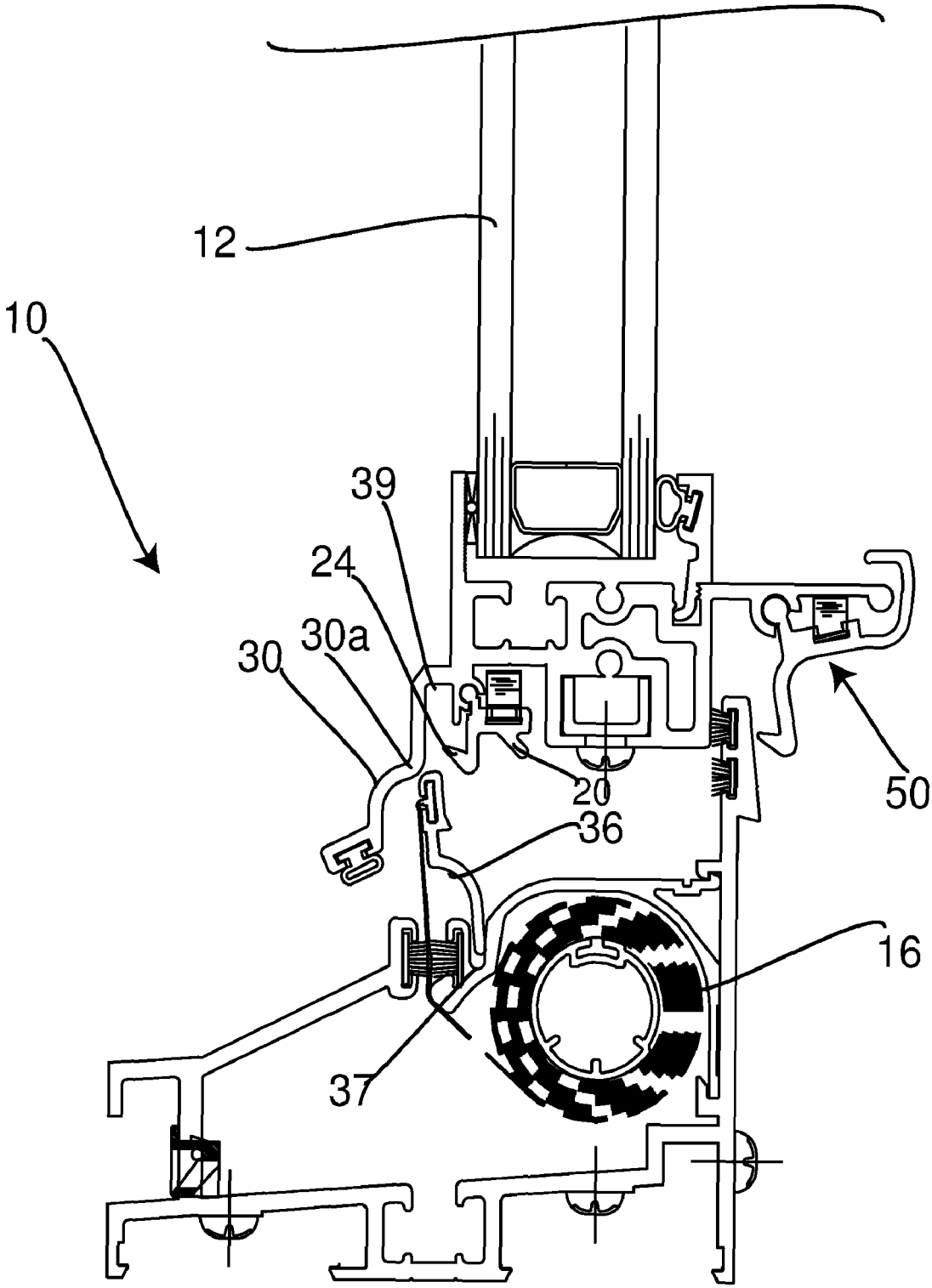
FIG. 5C is a side cross-sectional view of the device shown in FIG. 1A, with the bracket in a second misaligned position.

As shown in FIGS. 5B and 5C, lock 20, cover section 30, and bracket 36 are all shaped with rounded edges so that if bracket 36 is misaligned in channel 37, as is shown in FIG. 5B, lock 20 including rounded latch flange 24, can be used to guide a rounded top section of bracket 36 into an opposite receiving channel section 39.

FIG. 5C shows that if bracket 36 is misaligned in channel 37 in an opposite direction, a rounded section 30*a* of cover section 30 can be used to guide bracket 36 into channel 39.

These features, relating to the guidance of bracket 36 into channel 39 are also present in the device 110 as shown in FIGS. 2A and 2B.

Figure 6:
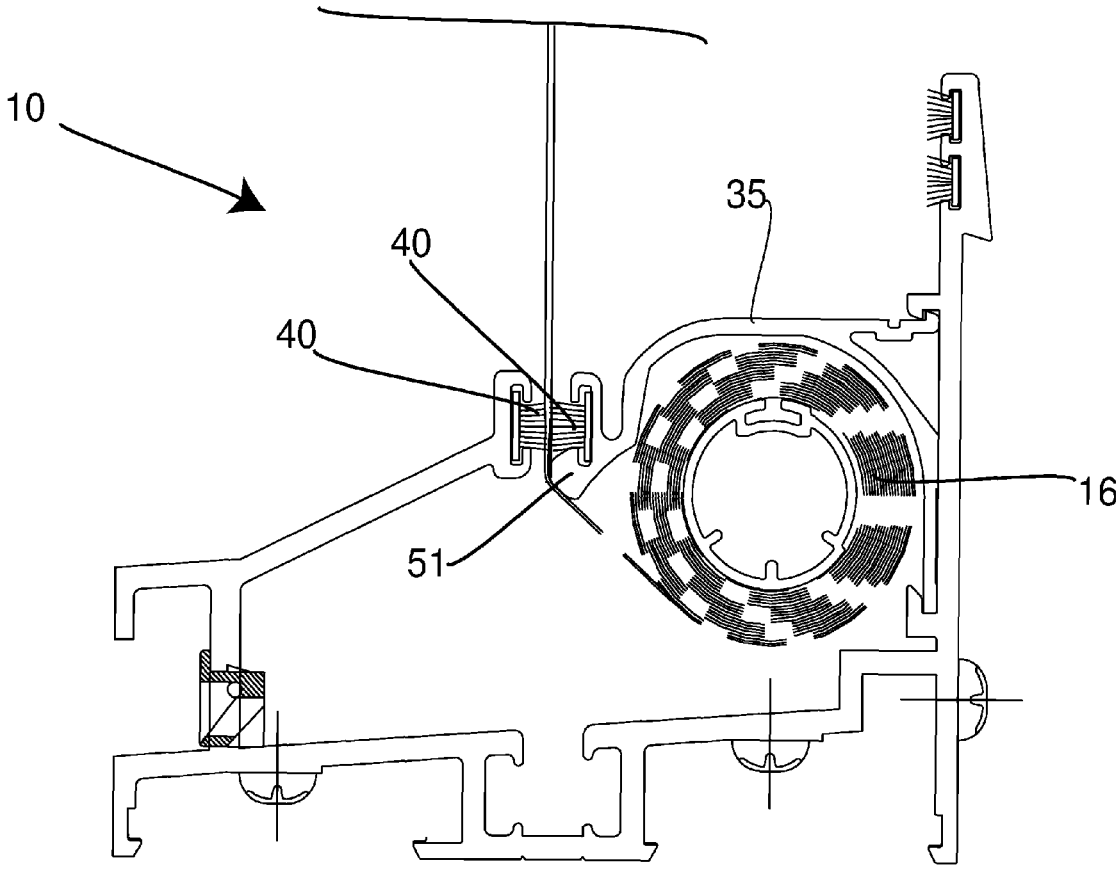
FIG. 6 shows a close up cross-sectional view of the screen housing.

FIG. 6 shows another cross-sectional view of the device as shown in FIG. 1A. With this view, there is shown a close up view of a rounded flange section 51 of housing cover 35. This rounded flange section is used to guide screen 16 up in an even manner into a channel and move through opposing bristles 40. The opposite device 110 shown in FIGS. 2A and 2B, can also include this feature.

Figure 7:
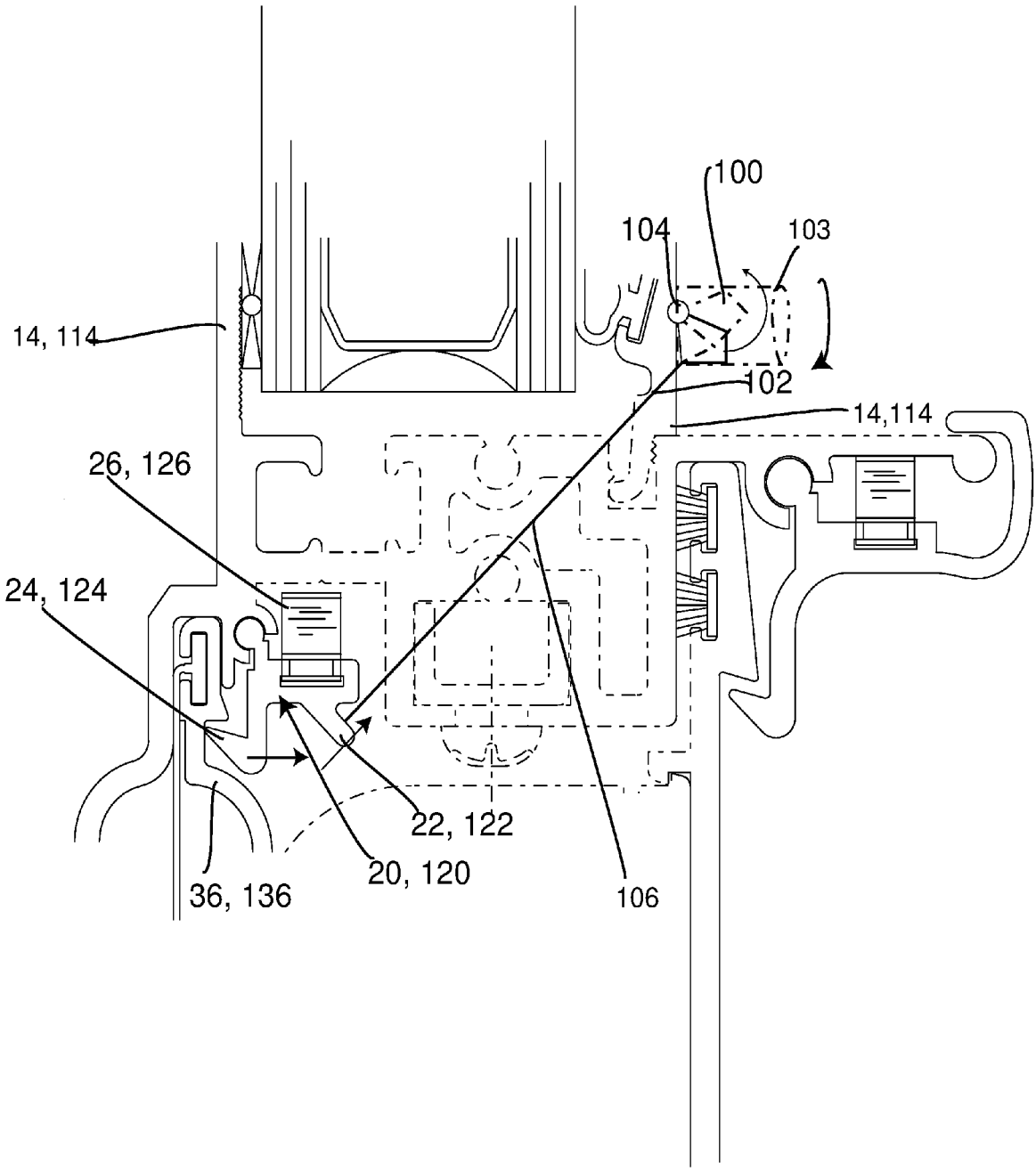
FIG. 7 shows an alternative embodiment of the invention.

FIG. 7 shows an alternative embodiment of the invention which includes a remote actuator such as a lever switch 100 which is rotatably coupled to a frame section such as frame section 14 via a rotatable joint 104. This remote lever switch is coupled to an extending connector 106 which can be in the form of a line such as a cord, a string or cable, or an arm made from a solid material, which is also coupled to lock 20. This extending connector 106 can extend through a gap or hole in frame section 14, to connect the two components. For example, this line can be coupled to flange section 22 on lock 20 so that when remote lever switch 100 is rotated, it pulls on extending connector 106 which then pulls on lock 20 via lever arm 22. Lock 20 can then rotate against spring 26 to move lock 20 into an open position. Lever switch 100 could also be made so that it could be positioned in a continuously open position. For example lever switch could be coupled to a knob 103 which is coupled to the sash frame 14 or 114, wherein when this knob is turned, it leaves the lever switch 100 in an open position so that lock 20 or 120 remains in this open position indefinitely, or until the user turns the knob back to its original position.

With this design, the user can detach screen 16 from the window sash 12 without having to open a window and rotate lock 20. This feature can also be present in the embodiment shown in FIG. 2A, wherein the corresponding reference numerals are shown in this FIG. 7 as well.

The ability to detach screen 16 or 116 from window sash 12, 112 without having to open window sash 12, 112 is important because if the screen is jammed on its roller, while the window sash is in a closed position, a user could not open the window to readjust the screen without either breaking the lock, the frame, or ripping an associated screen. In this way, a user can detach the window and save the screen if there is any unfortunate jamming of the screen on its roll.

Figure 8:
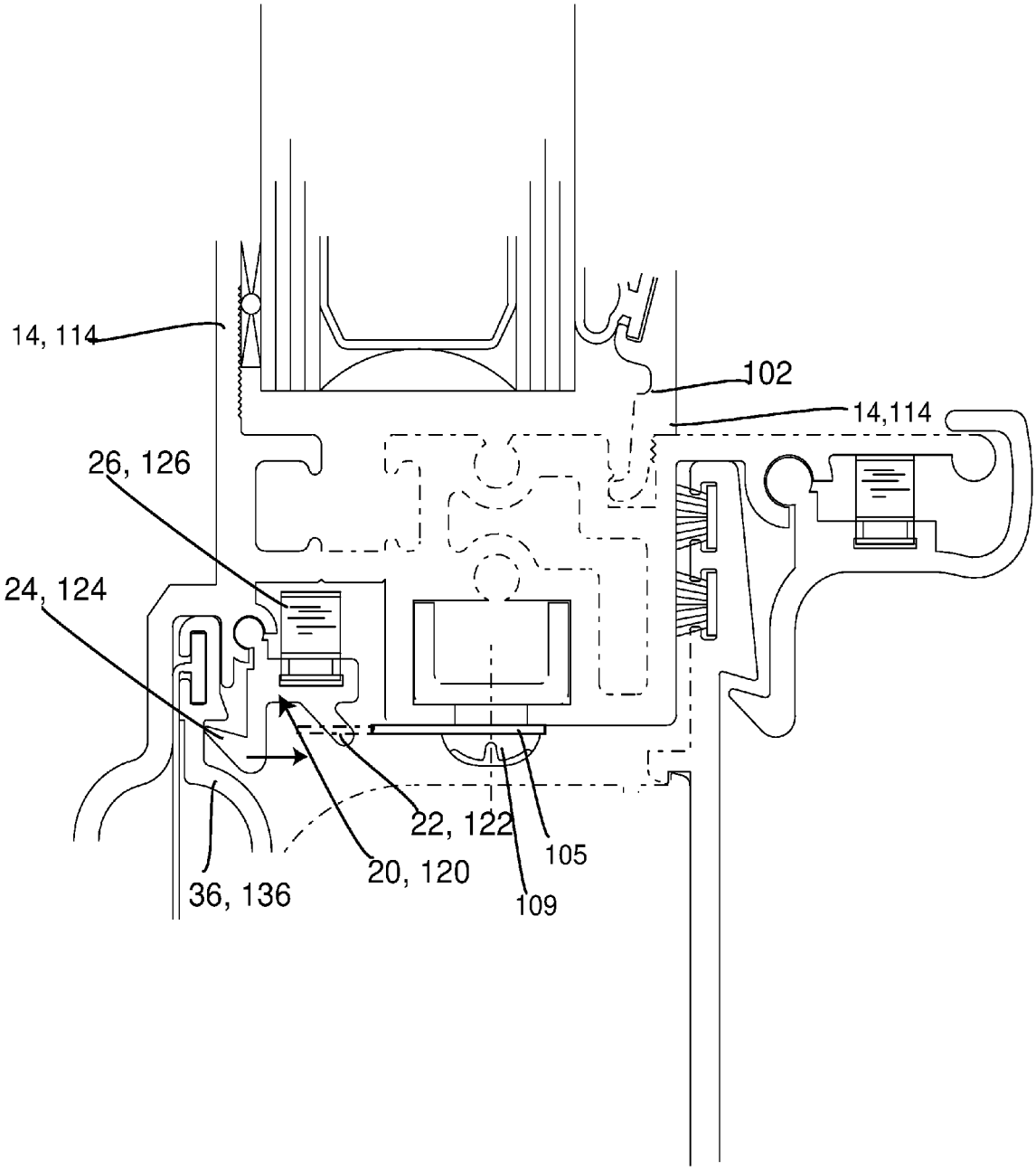
FIG. 8 is a side cross sectional view of another embodiment of the invention.

In another alternative embodiment, as shown in FIG. 8, there can be a locking flange or tongue 105 that can be attached to a screw 109, which is attached to the sash frame 114. In this case, flange 105 is rotatable such that it can be rotated out to a position below flange section 22 on lock 20 when lock 20 is pressed in an open position. In this way, lock 20 or alternatively lock 120 in the other embodiment, could be kept in a continuously open position so that it does not continue to lock with bracket 36 or 136 when the window is moved into a closed position.

Accordingly, while at least one embodiment of the present invention has been shown and described, it is to be understood that many changes and modifications may be made thereunto without departing from the spirit and scope of the invention as defined in the appended claims.

What is claimed is:

1. A window screen assembly for a window being disposed in a window frame comprising:

a) a housing coupled to the window frame, said housing having at least one groove;

b) at least one screen disposed in said housing;

c) at least one window sash moveable within the window frame;

d) at least one lock coupled to said at least one window sash; and e) at least one catch bracket coupled to said screen, said catch bracket having at least one section that is insertable into and detachable from said at least one groove in said housing, and said catch bracket having a connecting flange, wherein said at least one catch bracket is for selectively locking with said lock to lock said at least one screen to the window sash, wherein when said screen is locked to the window sash, it moves with the window sash in the window frame and wherein said catch bracket is for inserting into said at least one groove in said housing so that said catch bracket is supported on both sides of said groove to support said connecting flange in a position to catch said at least one lock on said at least one window sash;

f) a spring coupled to said at least one window sash, wherein said at least one lock is spring loaded and biased in a closed position to lock said at least one screen to the window sash; and g) at least one torsion spring coupled to said at least one screen in said housing, said at least one torsion spring for biasing said at least one screen in a retracted position.

2. The device as in claim 1, wherein said at least one lock has at least one hook section for coupling to said catch bracket.

3. The device as in claim 1, wherein said screen is disposed in said housing on a roll.

4. The device as in claim 1, wherein said housing is detachably coupled to the window frame.

5. The device as in claim 1, wherein said at least one catch bracket has at least one channel section to allow a screen having a flange to selectively connect to said at least one catch bracket.

6. The device as in claim 1, wherein said at least one catch bracket has at least one curved section, wherein said at least one catch bracket can be selectively positioned adjacent to said housing and outside of said housing groove, so that said at least one catch bracket cannot be locked with said lock when the window is in a closed position.

7. The device as in claim 6, wherein when said catch bracket is positioned adjacent to the housing, said screen spring keeps said catch bracket biased against said housing in a collapsed position.

8. The device as in claim 1, wherein said lock is rotationally coupled to the window.

9. The device as in claim 1, further comprising at least one spring loaded sash lock coupled to the window, wherein said at least one sash lock can be selectively locked to the housing to selectively lock the window sash in a closed position.

10. The device as in claim 1, wherein said catch bracket comprises a first base region, a curved section, a bracket section, and a connection flange wherein said curved section on said catch bracket is adapted to allow said catch bracket to lie flush on said housing.

11. The device as in claim 10, wherein said housing has a screen opening and wherein said catch bracket is adapted so that it can be placed to lie flush on said housing, so that said catch bracket covers said screen opening on said housing.

12. The device as in claim 1, wherein said curved section on said bracket is configured to provide a space between the screen and said catch bracket so that a user can grip said catch bracket.

13. The device as in claim 1, wherein said catch bracket further comprises a channel for coupling to a coupling flange on a screen.

14. The device as in claim 1, further comprising a spring coupled to said at least one window sash, wherein said at least one lock is spring loaded and biased in a closed position to lock said at least one screen to the window sash.

15. The device as in claim 1, further comprising at least one, one way valve to allow fluid to flow out from the housing.

16. The window screen assembly as in claim 1, wherein said spring comprises a leaf spring coupled to said at least one lock to bias said at least one lock in a closed position.

17. A window screen assembly for a window being disposed in a window frame comprising:

a) a housing coupled to the window frame, said housing having at least one groove;

b) at least one screen disposed in the window frame;

c) at least one window sash movably disposed in the window frame;

d) at least one lock coupled to said at least one window sash, said at least one lock for selectively locking said at least one screen to the window sash, wherein when said screen is locked to said window sash, said screen moves with said window sash in the window frame;

e) at least one spring coupled to said at least one lock to selectively lock said at least one screen to the window;

f) at least one sash lock coupled to said window sash, wherein said at least one sash lock can be selectively locked to the housing to selectively lock the window in a closed position, wherein said at least one sash lock further comprises a spring to bias said sash lock in a closed position;

g) at least one catch bracket coupled to said screen, said catch bracket having at least one section that is insertable into and detachable from said at least one groove in said housing, wherein said at least one catch bracket is for selectively locking with said lock to lock said at least one screen to the window sash, wherein when said screen is locked to the window sash, it moves with the window sash in the window frame and wherein said catch bracket comprises a first base region, a curved section, a bracket section, and a connecting flange wherein said first base region is for inserting into said at least one groove in said housing so that said catch bracket is supported on both sides of said groove to support said connecting flange in a position to catch said at least one lock on said at least one window sash;

h) a spring coupled to said at least one window sash, wherein said at least one lock is spring loaded and biased in a closed position to lock said at least one screen to the window sash.

18. A window screen assembly for a window being disposed in a window frame comprising:

a) a housing coupled to a window frame, said housing having at least one groove;

b) at least one screen disposed in the window frame;

c) at least one lock for selectively locking said at least one screen to the window sash, wherein when said screen is locked to the window sash, it moves with the window sash in the window frame wherein said at least one lock includes a spring coupled to the lock to selectively lock said at least one screen to the window sash;

d) at least one catch bracket coupled to said screen, wherein when said catch bracket is insertable into and detachable from said groove, and wherein said groove supports said catch bracket, and is secured to support a connecting flange in a position to catch said at least one lock;

e) at least one remote actuator formed as a lever switch which is rotatably coupled to the window frame; and f) at least one extending connector coupled to said lock at a first end and to said at least one remote actuator at a second end, wherein said remote actuator can be selectively moved to move said at least one extending connector to selectively move said at least one lock from a first position to a second position to either selectively lock said lock to said screen or selectively unlock said lock from said screen.

19. The device as in claim 18, wherein said at least one remote actuator is rotatably coupled to an outside surface of the housing.

20. The device as in claim 18, wherein said at least one extending connector is in the form of a line coupling said at least one lock to said at least one remote actuator.

21. The device as in claim 20, wherein said at least one extending connector is in the form of a cable.

22. A window screen assembly for a window being disposed in a window frame comprising:

a) a housing coupled to the window frame, said housing having at least one groove;

b) at least one screen disposed in said housing;

c) at least one window sash moveable within the window frame;

d) at least one lock coupled to said at least one window sash; and e) at least one catch bracket coupled to said screen, said catch bracket having at least one section that is insertable into and detachable from said at least one groove in said housing, wherein said at least one catch bracket is for selectively locking with said lock to lock said at least one screen to the window sash, wherein when said screen is locked to the window sash, it moves with the window sash in the window frame and wherein said catch bracket is for inserting into said at least one groove in said housing so that said catch bracket is supported on both sides of said groove to support said connecting flange in a position to catch said at least one lock on said at least one window sash;

f) a spring coupled to said at least one window sash, wherein said at least one lock is spring loaded and biased in a closed position to lock said at least one screen to the window sash; and g) at least one torsion spring coupled to said at least one screen in said housing, said at least one torsion spring for biasing said at least one screen in a retracted position wherein said bracket has a curved section and is rotatable from a substantially vertical extension to a substantially horizontal extension such that said curved section is positioned against said housing.

23. The window screen assembly as in claim 22, wherein said spring comprises a leaf spring coupled to said at least one lock to bias said at least one lock in a closed position.

24. The window screen assembly as in claim 22, wherein said catch bracket is rotatably coupled to said screen.

25. The window screen assembly as in claim 24, wherein said catch bracket has a bracket section having a channel, and said screen has a connection flange wherein said connection flange is coupled to said bracket section by inserting said connecting flange into said channel, to form a rotatable connection between said catch bracket and said screen.

* * * * *